US008851633B2

(12) United States Patent
Kubo et al.

(10) Patent No.: US 8,851,633 B2
(45) Date of Patent: Oct. 7, 2014

(54) LIQUID EJECTION APPARATUS

(75) Inventors: Tomoyuki Kubo, Nagoya (JP); Atsushi Ito, Nagoya (JP); Yusuke Suzuki, Nishio (JP); Yasuo Kato, Aichi-ken (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 181 days.

(21) Appl. No.: 13/362,198

(22) Filed: Jan. 31, 2012

(65) Prior Publication Data

US 2012/0206542 A1 Aug. 16, 2012

(30) Foreign Application Priority Data

Feb. 10, 2011 (JP) ..... 2011-027749

(51) Int. Cl.
*B41J 2/05* (2006.01)

(52) U.S. Cl.
USPC ..... 347/57; 347/58

(58) Field of Classification Search
USPC ..... 347/57
See application file for complete search history.

(56) References Cited

U.S. PATENT DOCUMENTS

| | | | | |
|---|---|---|---|---|
| 6,334,668 | B1 | 1/2002 | Isamoto | |
| 7,661,799 | B2 * | 2/2010 | Kubo et al. | 347/58 |
| 2005/0062806 | A1 | 3/2005 | Terakura et al. | |
| 2008/0316255 | A1 | 12/2008 | Kubo et al. | |

FOREIGN PATENT DOCUMENTS

| | | | |
|---|---|---|---|
| JP | H06-182994 | A | 7/1994 |
| JP | 2000-326510 | A | 11/2000 |
| JP | 2000-343690 | A | 12/2000 |
| JP | 2008-279734 | A | 11/2008 |
| JP | 2009-004419 | A | 1/2009 |
| JP | 2009-214480 | A | 9/2009 |
| JP | 2010-095005 | A | 4/2010 |

OTHER PUBLICATIONS

Japan Patent Office, Notification of Reason for Refusal for Japanese Patent Application No. 2011-027749 (counterpart Japanese patent application), mailed Mar. 12, 2013.
Japan Patent Office, Notification of Reason for Refusal for Japanese Patent Application No. 2011-027749 (counterpart to above-captioned patent application), mailed Sep. 3, 2013.

* cited by examiner

*Primary Examiner* — Matthew Luu
*Assistant Examiner* — Renee I Wilson
(74) *Attorney, Agent, or Firm* — Baker Botts L.L.P.

(57) ABSTRACT

A liquid ejection apparatus including: a head having: nozzles arranged in a nozzle-row direction; and ejection-energy applying portions; a drive IC for driving the ejection-energy applying portions; a control circuit board for controlling the drive IC; a wiring member on which the drive IC is mounted; and a support member for supporting the wiring member. The wiring member extends toward the control circuit board from a connection portion thereof connected to the ejection-energy applying portions, the wiring member having a first wiring portion extending in a first direction intersecting the nozzle-row direction and a second wiring portion extending in a second direction intersecting the first direction. The support member supports at least one of the first wiring portion and the second wiring portion, the at least one being located between the ejection-energy applying portions and the control circuit board.

15 Claims, 12 Drawing Sheets

LIQUID EJECTION APPARATUS

CROSS REFERENCE TO RELATED APPLICATION

The present application claims priority from Japanese Patent Application No. 2011-027749, which was filed on Feb. 10, 2011, the disclosure of which is herein incorporated by reference in its entirety.

BACKGROUND OF THE INVENTION

1. Field of the Invention

The present invention relates to a liquid ejection apparatus configured to eject liquid from nozzles.

2. Description of the Related Art

There is conventionally known a liquid ejection head in which a piezoelectric element unit is disposed on a portion of an upper face of a vibration plate for covering pressure chambers, which portion is opposed to the pressure chambers. A piezoelectric element for constituting the piezoelectric element unit has one side face bonded to a fixation board, whereby the piezoelectric element is fixed to the fixation board. A flexible wiring board is connected to another side face of the piezoelectric element which is opposite to the one side face bonded to the fixation board. The flexible wiring board extends upward from a portion thereof connected to the piezoelectric element to the wiring board. Further, the drive circuit is mounted on a midway portion of the flexible wiring board, whereby the piezoelectric element and the drive circuit are connected to each other via wirings formed on the flexible wiring board. The drive circuit and the wiring board are also connected to each other via wirings formed on the flexible wiring board.

SUMMARY OF THE INVENTION

In recent years, in an ink-jet printer configured to perform recording by ejecting ink from nozzles, there has been a trend of increase in the number of the nozzles in order to reduce a time required for the recording and improve an image quality, for example.

In the conventional liquid ejection head, since electrodes of the piezoelectric element are disposed at positions corresponding to the respective nozzles, the larger the number of the nozzles, the larger the flexible wiring board connected to the electrodes of the piezoelectric element becomes. Meanwhile, even where the number of connecting terminals for being connected to the drive wirings connected to the respective electrodes of the piezoelectric element has increased in accordance with the increased number of the nozzles, the drive circuit can be produced without being made so much larger in a nozzle-row direction. In contrast, where a size of the drive circuit is adapted to or matched with the length of the flexible wiring board in the nozzle-row direction, the size of the drive circuit is made larger, leading to an increased cost.

Where the length of the drive circuit is shorter than the length of the nozzle row, there is formed an area (like an area A in FIG. 5) in which the drive wirings are disposed so as to extend from the electrodes of the piezoelectric element toward the connecting terminal of the drive circuit while being inclined with respect to a direction perpendicular to the nozzle row. In this area A, a distance Δ between each two of the drive wirings is narrow when compared with an area B in which the drive wirings are disposed so as to extend in the direction perpendicular to the nozzle-row direction. Further, the larger the inclined angle θ of the drive wirings in the area A, that is, the shorter a distance between the piezoelectric element and the drive circuit, the narrower the distance Δ between the drive wirings becomes. Where the distance Δ between the drive wirings is narrow, an electric crosstalk may occur between the drive wirings, and a short circuit may be made in forming the drive wirings.

Thus, in order to obtain the distance Δ equal to or greater than a predetermined distance in the area A, a relatively long distance between the piezoelectric element and the drive circuit is needed to reduce the above-described inclined angle θ. Further, not only in the case where the drive wirings are inclined with respect to the direction perpendicular to the nozzle row, but also in a case where the drive wirings include wiring extending in a direction parallel to the nozzle row and wiring extending in a direction perpendicular to the nozzle row, the distance between the piezoelectric element and the drive circuit is needed to be longer to obtain the distance between the drive wirings which is equal to or longer than the predetermined distance. However, the increase in the distance between the piezoelectric element and the drive circuit leads to an increase in size of the apparatus.

This invention has been developed in view of the above-described situations, and it is an object of the present invention to provide a liquid ejection apparatus capable of preventing an increase in size of the apparatus even where a length of a wiring member is relatively long.

The object indicated above may be achieved according to the present invention which provides a liquid ejection apparatus including: at least one liquid ejection head each having: a plurality of nozzles arranged in a nozzle-row direction; a plurality of liquid channels respectively communicating with the plurality of nozzles; and a plurality of ejection-energy applying portions respectively corresponding to the plurality of liquid channels and arranged in the nozzle-row direction; a drive IC configured to drive the plurality of ejection-energy applying portions; a control circuit board configured to control the drive IC; a flexible wiring member on which the drive IC is mounted, the wiring member including: a plurality of drive wirings for respectively connecting the plurality of ejection-energy applying portions and the drive IC to each other; and a control wiring for connecting the drive IC and the control circuit board to each other, the wiring member having a length longer than that of the drive IC in the nozzle-row direction, the wiring member being provided at least between the plurality of ejection-energy applying portions and the control circuit board; and a support member configured to support the wiring member, wherein the plurality of ejection-energy applying portions and the control circuit board are disposed so as to be distant from each other in a first direction that intersects the nozzle-row direction, wherein the wiring member extends toward the control circuit board from a connection portion thereof connected to the plurality of ejection-energy applying portions, the wiring member having a first wiring portion extending in the first direction and a second wiring portion extending in a second direction that intersects the first direction, and wherein the support member is configured to support at least one of the first wiring portion and the second wiring portion of the wiring member, the at least one being located between the plurality of ejection-energy applying portions and the control circuit board.

BRIEF DESCRIPTION OF THE DRAWINGS

The objects, features, advantages, and technical and industrial significance of the present invention will be better understood by reading the following detailed description of an embodiment of the invention, when considered in connection with the accompanying drawings, in which.

DETAILED DESCRIPTION OF THE EMBODIMENTS

Hereinafter, there will be described an embodiment of the present invention by reference to the drawings.

Figure 1:
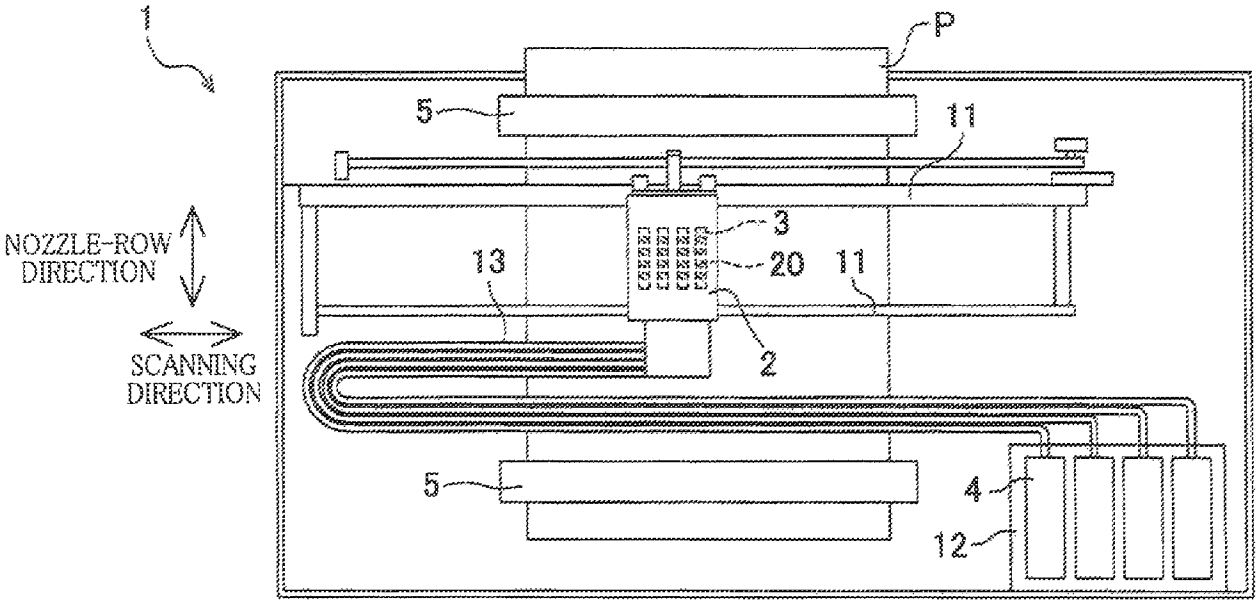
FIG. 1 is a schematic view showing of a printer as an embodiment of the present invention.

As shown in FIG. 1, a printer 1 (as one example of a liquid ejection apparatus) as one embodiment of the present invention includes a carriage 2, ink-jet heads 3, ink cartridges 4, a sheet conveyance rollers 5, and so on.

The carriage 2 is configured to reciprocate along guide rails 11 in a scanning direction coinciding with a rightward and leftward direction in FIG. 1. The four ink-jet heads 3 (each as one example of a liquid ejection head) are mounted on the carriage 2 so as to be arranged in the scanning direction. Each of the ink-jet heads 3 ejects ink from a multiplicity of nozzles 20 formed in a lower face (nozzle face) thereof. More specifically, the four ink-jet heads 3 respectively eject inks of respective four colors, namely, black, yellow, cyan, and magenta in order from the rightmost head 3 in FIG. 1. The nozzles 20 formed in each ink-jet head 3 are arranged in a nozzle-row direction (i.e., an upward and downward direction in FIG. 1) that is perpendicular to the scanning direction.

The four ink cartridges 4 are mounted on a cartridge mount 12 so as to be respectively connected to the four ink-jet heads 3 via tubes 13. The four ink cartridges 4 mounted on the cartridge mount 12 are arranged in the scanning direction and respectively store the inks of the respective four colors, namely, black, yellow, cyan, and magenta in order from the rightmost cartridge 4 in FIG. 1. The inks of the respective colors are supplied from the four ink cartridges 4 to the four ink-jet heads 3, respectively.

The sheet conveyance rollers 5 are driven by a motor, not shown, for example, and convey a recording sheet P toward a lower side (in a direction parallel to the nozzle-row direction) in FIG. 1.

In the printer 1, the ink-jet heads 3 reciprocated in the scanning direction with the carriage 2 respectively eject the inks onto the recording sheet P conveyed by the sheet conveyance rollers 5 to perform image recording on the recording sheet P.

Figure 2:
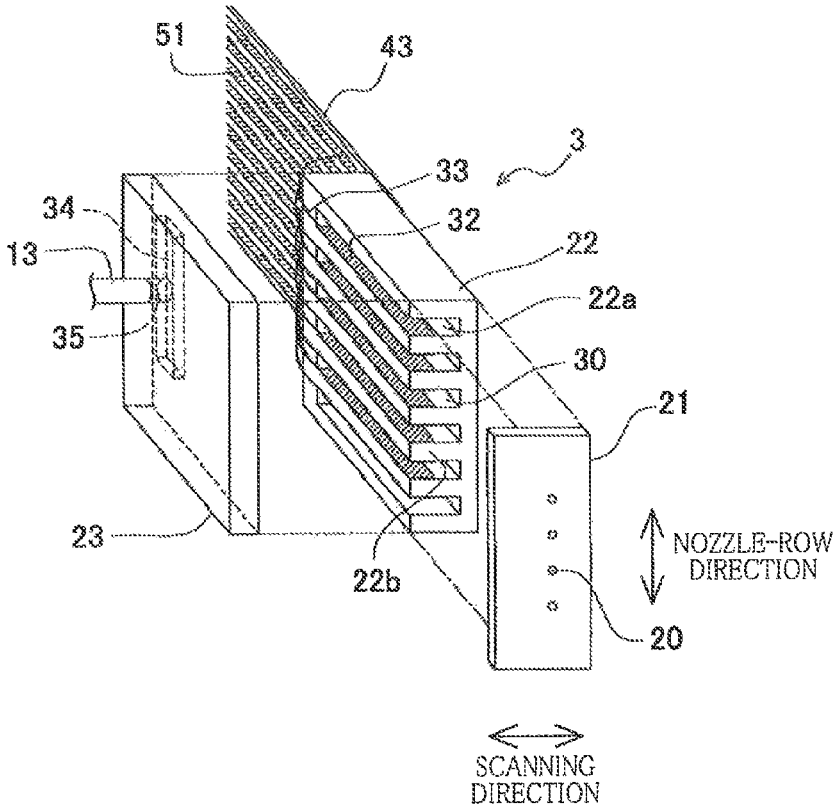
FIG. 2 is an exploded perspective view showing an ink-jet head.

There will be next explained the ink-jet heads 3 and components therearound in detail. It is noted that, since the four heads 3 have the same configuration, an explanation is given for one of the heads 3 for the sake of simplicity. As shown in FIG. 2, the ink-jet head 3 includes a nozzle plate 21, a piezoelectric plate 22, and a cover plate 23.

The nozzle plate 21 is a plate formed of, e.g., a synthetic resin and having the nozzles 20 formed therein so as to be arranged in the nozzle-row direction. The piezoelectric plate 22 is formed of a piezoelectric material mainly composed of lead zirconate titanate (PZT) that is a mixed crystal of lead titanate and zirconate titanate. The piezoelectric plate 22 is disposed on an upper face of the nozzle plate 21.

The piezoelectric plate 22 has a plurality of grooves 22*a* arranged in the nozzle-row direction. Each of the grooves 22*a* opens in a one-side end face of the piezoelectric plate 22 in the scanning direction and extends in an upward and downward direction (i.e., a vertical direction). The grooves 22*a* other than two opposite-end grooves 22*a* in the nozzle-row direction form or function as pressure chambers 30 (each as one example of a liquid channel).

Each of the grooves 22*a* extends to a lower face of the piezoelectric plate 22 to be bonded to the nozzle plate 21 and opens in the lower face at a lower end of the groove 22*a*. As a result, each of the pressure chambers 30 is communicated with a corresponding one of the nozzles 20 when the piezoelectric plate 22 is bonded to the nozzle plate 21. The piezoelectric plate 22 has wall portions 22*b*, each two of which function as opposite side walls for defining a corresponding one of the pressure chambers 30 in the nozzle-row direction. A plurality of electrodes 32 are formed on the wall portions 22*b* such that each of the wall portions 22*b* are interposed between corresponding two of the electrodes 32 in the nozzle-row direction. Wires 33 are respectively connected to the electrodes 32, and the wires 33 are drawn to an outside of the ink-jet head 3.

It is noted that, in the present embodiment, the two wall portions 22*b* as the opposite side walls of the pressure chamber 30 that extend in the direction perpendicular to the nozzle-row direction, the electrodes 32 formed respectively on the wall portions 22*b*, and the wires 33 for drawing the electrodes 32 to the outside of the ink-jet head 3 are one example of an ejection-energy applying portion. It is noted that, in the present embodiment, the wall portion 22*b* interposed between the adjacent two pressure chambers 30, the electrodes 32 formed on the wall portion 22*b*, and the wires 33 respectively connected to the electrodes 32 function as part of two ejection-energy applying portions corresponding to the two pressure chambers 30. These ejection-energy applying portions corresponding to the pressure chambers are arranged in the nozzle-row direction.

The cover plate 23 is bonded to the piezoelectric plate 22 so as to cover one-side openings of the respective pressure chambers 30 in the scanning direction. The cover plate 23 has (i) a common ink chamber 34 expanding in the nozzle-row direction across positions that face end portions of the respective pressure chambers 30, each of which is an end portion of the corresponding pressure chamber 30 different from an end portion thereof having the nozzle 20, and (ii) an ink supply opening 35 communicating with the common ink chamber 34 and opening in a face of the cover plate 23 opposite to a face thereof on which the piezoelectric plate 22 is provided (that is, the ink supply opening 35 is located on one side of the ejection-energy applying portion in the scanning direction as one example of a second direction). The above-described tube 13 (as one example of a supply-channel forming member) is connected to the ink supply opening 35, and the ink of the ink cartridge 4 is supplied from the ink supply opening 35 to the ink-jet head 3.

Here, there will be explained a method of driving the ink-jet head 3 to eject the ink from the nozzles 20. In the ink-jet head 3, all the electrodes 32 are kept at ground potential in advance by a drive IC 44 which will be described below. In the ejection of the ink from one of the nozzles 20, the drive IC 44 applies a positive electric potential to one of the electrodes 32 of each pair of two pairs of the electrodes 32, which each pair corresponds to one of the two wall portions 22*b* located on opposite sides of the pressure chamber 30 corresponding to the nozzle 20. As a result, a potential difference is generated between each pair of the electrodes 32, whereby an electric field is generated in the nozzle-row direction on the wall portions 22*b* each interposed between the corresponding electrodes 32.

Here, each wall portion 22*b* is polarized in the scanning direction in advance. Since the direction of the above-described electric field is perpendicular to the direction of this polarization, the wall portion 22*b* is deformed such that a central portion thereof projects toward the pressure chambers 30 by a piezoelectric thickness shear effect, lowering a volume of the pressure chamber 30. As a result, a pressure of the ink in the pressure chamber 30 is increased, whereby the ink is ejected from the nozzle 20 communicating with the pressure chamber 30.

Figure 3:
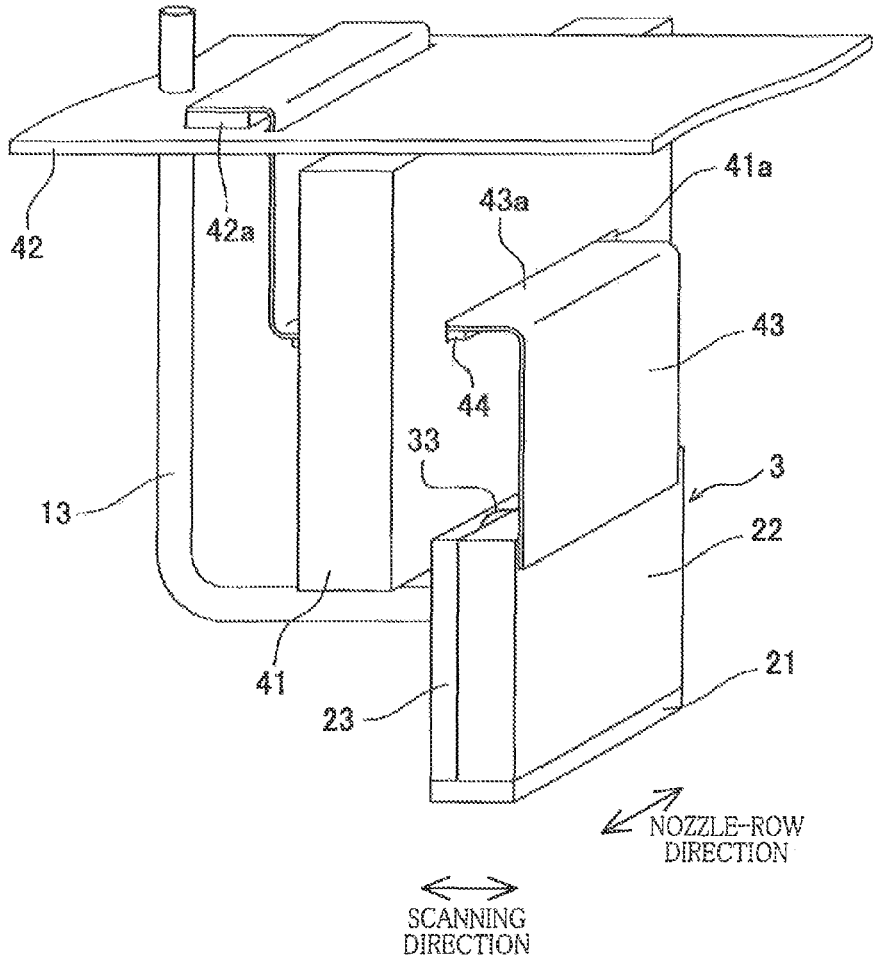
FIG. 3 is a perspective view showing the ink-jet head and components therearound.
Figure 4:
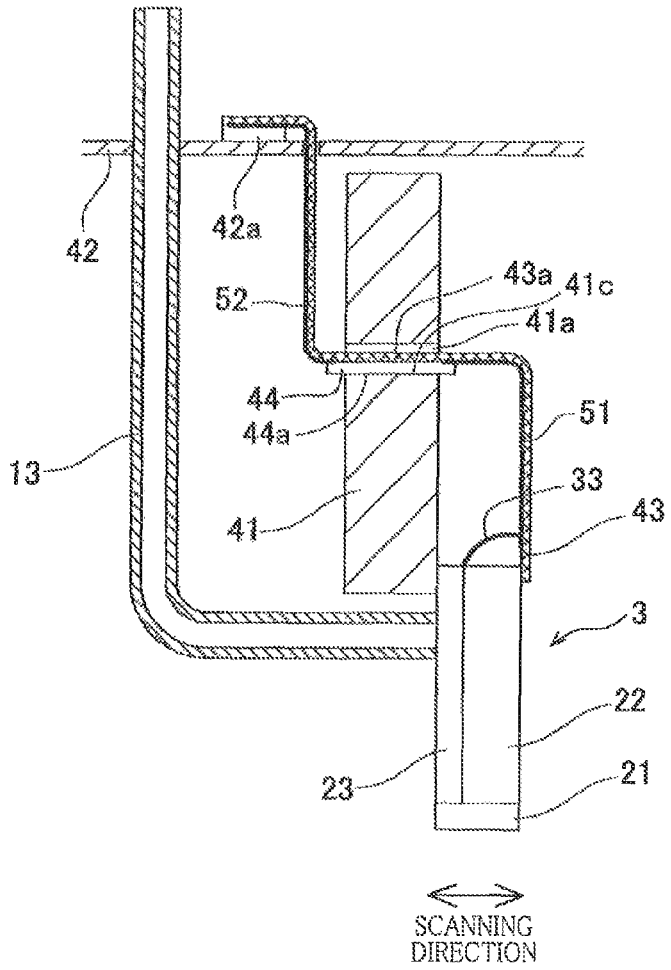
FIG. 4 is a cross-sectional view of a generally central portion of the components in FIG. 3 in a nozzle-row direction.

As shown in FIGS. 3 and 4, in the ink-jet head 3, the side face of the cover plate 23 which is opposite to a side face thereof contacting the piezoelectric plate 22 is bonded to a right side face (in FIG. 3) of a fixation member 41 (as one example of a support member) provided on the carriage 2 (in other words, the side face of the cover plate 23 is bonded to the side face of the fixation member 41 which is located on the other side (that is opposite to the above-described one side) in the second direction). As a result, the ink-jet head 3 is fixed to the fixation member 41.

The fixation member 41 is a generally rectangular parallelepiped member formed of, e.g., a metal material and extending from a position above the nozzle face of the ink-jet head 3 and below the upper end of the ink-jet head 3, to a position above the upper end of the ink-jet head 3. On an upper side of the fixation member 41 in the carriage 2, there is disposed a control circuit board 42 expanding in the scanning direction and the nozzle-row direction and configured to control an operation of the four ink-jet heads 3. The ink-jet head 3 and the control circuit board 42 are disposed so as to be distant from each other in an upward and downward direction (as one example of a first direction) in FIG. 3.

The ink-jet head 3 and the control circuit board 42 are electrically connected to each other by a chip on film (COF) 43. More specifically, the COF 43 is a flexible wiring member and bonded at its lower end portion to a side face of the piezoelectric plate 22 opposite to one side face thereof covered by the cover plate 23 (that is, the COF 43 is bonded to the other side face of the piezoelectric plate 22 which is located on the other side of the fixation member 41 in the second direction). The COF 43 extends upward (in the first direction) from its portion bonded to the piezoelectric plate 22 (a connection portion between the wires 33 and drive wirings 51 which will be described below) toward the control circuit board 42 and connected to the control circuit board 42 at an upper end portion of the COF 43. The COF 43 has a bent portion 43*a* at a central portion of the COF 43 in the vertical direction, and the bent portion 43*a* is bent so as to extend in the scanning direction. That is, the COF 43 includes a first wiring portion extending in the first direction and a second wiring portion extending in the first direction and the second direction.

Here, the fixation member 41 has a slit 41*a* that is formed at a portion thereof opposed to the bent portion 43*a*. The slit 41*a* extends through the fixation member 41 in the scanning direction. The bent portion 43*a* extends through the slit 41*a* to a left side of the fixation member 41 in FIG. 3 (i.e., to one side of the fixation member 41 in the second direction). It is noted that the fixation member 41 has two faces defining the slit 41*a*, and one of the two faces which faces upward is an upper face 41*c*. As will be described later, the COF 43 is supported by the upper face 41*c*.

Figure 5:
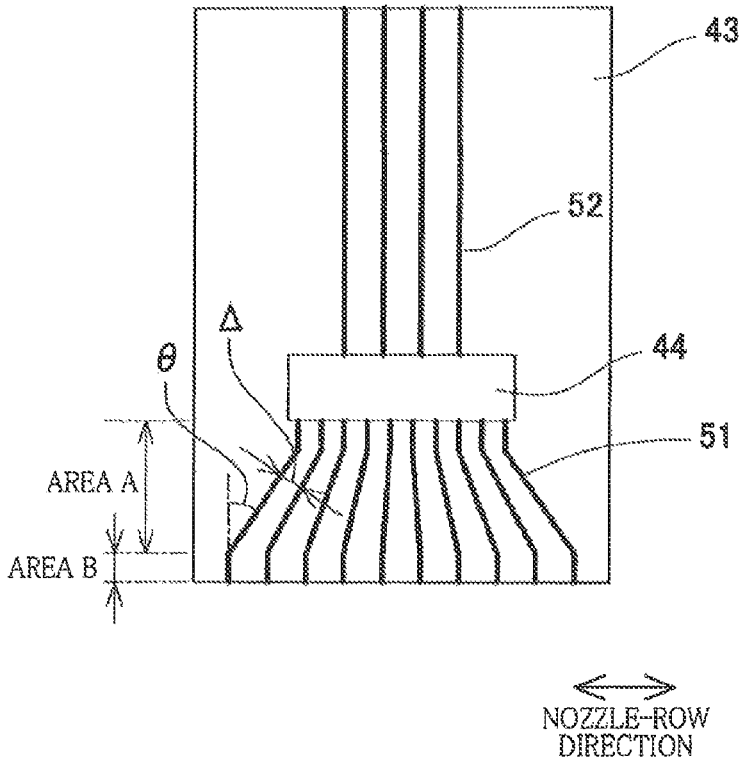
FIG. 5 is a plan view showing a COF in a state in which the COF is spread.

As shown in FIG. 5, the drive IC 44 is mounted on a face of the bent portion 43*a* in the slit 41*a* so as to be held in contact with the face defining the slit 41*a* (i.e., the upper face 41*c*). As a result, the bent portion 43*a* is supported on the fixation member 41 in the slit 41*a* at the portion of the bent portion 43*a* on which the drive IC 44 is mounted. That is, the COF 43 is supported by the fixation member 41 via the drive IC 44, and the fixation member 41 is held in direct contact with the drive IC 44, and the upper face 41*c* of the fixation member 41 is held in direct surface contact with a face 44*a* of the drive IC 44 (that is a face not mounted on the COF 43). The drive IC 44 may not only contact the wall of the slit 41*a* but also be bonded to the wall by adhesive, for example.

As shown in FIG. 5, the drive wirings 51 respectively for the electrodes 32 are formed in the COF 43 between the portion of the COF 43 bonded to the piezoelectric plate 22 and the portion of the COF 43 on which the drive IC 44 is mounted. The wires 33 drawn from the respective electrodes 32 are respectively connected to one end portions of the respective drive wirings 51 which are located near the portion of the COF 43 bonded to the piezoelectric plate 22, and the drive IC 44 is connected to the other end portions of the respective drive wirings 51. The drive IC 44 applies the electric potential to the electrodes 32 via the drive wirings 51 and the wires 33 (that is, the drive IC 44 drives the ejection-energy applying portions).

A control wirings 52 are formed in the COF 43 between (i) the portion of the COF 43 on which the drive IC 44 is mounted and (ii) the portion of the COF 43 which is connected to the control circuit board 42. The number of the control wirings 52 is less than that of the drive wirings 51 formed respectively for the electrodes 32. One end portions of the respective control wirings 52 are connected to the drive IC 44, and the other end portions of the respective control wirings 52 are connected to a connecting terminal 42*a* that is provided on an upper face of the control circuit board 42. The control circuit board 42 is connected to another circuit board, not shown, provided on a main body of the printer 1. The control circuit board 42 controls the drive IC 44 by transmitting a clock, a control signal, and the like to the drive IC 44 via the control wirings 52 on the basis of a clock, a signal, and the like transmitted from the another circuit board. That is, the control circuit board 42 controls the ink-jet head 3 by controlling the drive IC 44 that drives the ink-jet head 3.

The tube 13 connected to the ink supply opening 35 extends from the ink supply opening 35 so as to pass through a position located on a left side of the portion of the COF 43 that is located on a left side of the fixation member 41 in FIG. 3. The tube 13 is then drawn to a position above the control circuit board 42 so as to extend to the cartridge mount 12.

Here, in an ink-jet printer like the printer 1 in which the recording is performed on the recording sheet P by ejecting the ink from the nozzles 20, there has been a trend of increase in the number of the nozzles 20 in order to reduce a time required for the recording and improve an image quality.

In a case where the number of the nozzles 20 has been increased, the number of the electrodes 32 of the piezoelectric plate 22 also increases in accordance with the increased number of the nozzles 20. As a result, the number of the drive wirings 51 connected to the electrodes 32 is also increased, whereby a width of the COF 43 (i.e., a length thereof in the nozzle-row direction) is made larger. Meanwhile, even where the number of the connecting terminals 42*a* has increased in accordance with the increased number of the drive wirings 51, the drive IC 44 can be produced without being made larger in the nozzle-row direction than the COF 43. Thus, as shown in FIG. 5, a length of the COF 43 in the nozzle-row direction is longer than that of the drive IC 44, and the drive wirings 51 are drawn from the drive IC 44 in the direction perpendicular to the nozzle-row direction in an area B between the drive IC 44 of the COF 43 and the piezoelectric plate 22, and then the drive wirings 51 extends in an area A in directions inclined with respect to the direction perpendicular to the nozzle-row direction.

Here, the shorter a length of the area A in the direction perpendicular to the nozzle-row direction, the larger an inclined angle θ becomes, that is, the narrower a distance Δ between two of the drive wirings 51 becomes. Where the distance Δ between the drive wirings is narrow, an electric crosstalk may occur between the drive wirings, and a short circuit may be made in forming the drive wirings. Thus, in the present embodiment, in order to obtain the enough distance Δ, a relatively long length of the area A in the direction perpendicular to the nozzle-row direction is required for reducing the inclined angle θ.

In this case, the longer the length of the area A in the direction perpendicular to the nozzle-row direction, the longer a length of the COF 43 becomes between (i) the portion of the COF 43 on which the drive IC 44 is mounted and (ii) the portion of the COF 43 which is connected to the piezoelectric plate 22. However, in the present embodiment, the bent portion 43*a* is provided on the COF 43. Thus, even where the length of the area A between the portion of the COF 43 on which the drive IC 44 is mounted and the portion of the COF 43 which is connected to the piezoelectric plate 22 is made relatively long, a distance between the ink-jet head 3 and the control circuit board 42 in the upward and downward direction does not become large. Accordingly, it is possible to prevent the carriage 2 from increasing in size in the upward and downward direction in FIG. 3 where the ink-jet head 3 has a relatively large number of the nozzles 20, and it is possible to prevent the printer 1 including the carriage 2 from increasing in size.

Further, in the present embodiment, the bent portion 43*a* is supported by the fixation member 41. Thus, even where the bent portion 43*a* has a relatively long length, it is possible to prevent the bent portion 43*a* from hanging down. As a result, it is possible to prevent the bent portion 43*a* from contacting the ink-jet head 3, thereby preventing that such a contact has a disadvantageous effects on ink ejection characteristics of the ink-jet head 3.

Further, in the present embodiment, the fixation member 41 for fixing the piezoelectric plate 22 extends to the position above the piezoelectric plate 22, and the bent portion 43*a* is supported by the fixation member 41. Thus, a component for supporting the bent portion 43*a* does not need to be provided in addition to the fixation member 41, thereby simplifying the printer 1.

Further, in the present embodiment, the slit 41*a* extending through the fixation member 41 in the scanning direction is formed through the fixation member 41 whose upper end is higher than the bent portion 43*a*, and the bent portion 43*a* is inserted in the slit 41*a* and supported by the fixation member 41 in the slit 41*a*. Thus, it is possible to easily support the bent portion 43*a* by the fixation member 41.

In addition, in the present embodiment, a relatively heavy part of the bent portion 43*a* on which the drive IC 44 is mounted is supported by the fixation member 41 in the slit 41*a*. This makes it possible to reliably prevent the bent portion 43*a* from hanging down.

Further, in the present embodiment, the drive IC 44 is held in contact with the fixation member 41 formed of the metal material. Thus, a heat generated by the drive IC 44 is efficiently dissipated from the fixation member 41. That is, in the present embodiment, the fixation member 41 functions also as a heat sink for dissipating the heat of the drive IC 44.

There will be next explained modifications of the above-described embodiment. It is noted that the same reference numerals as used in the above-described embodiment are used to designate the corresponding elements of the following modifications, and an explanation of which is dispensed with.

Figure 6:
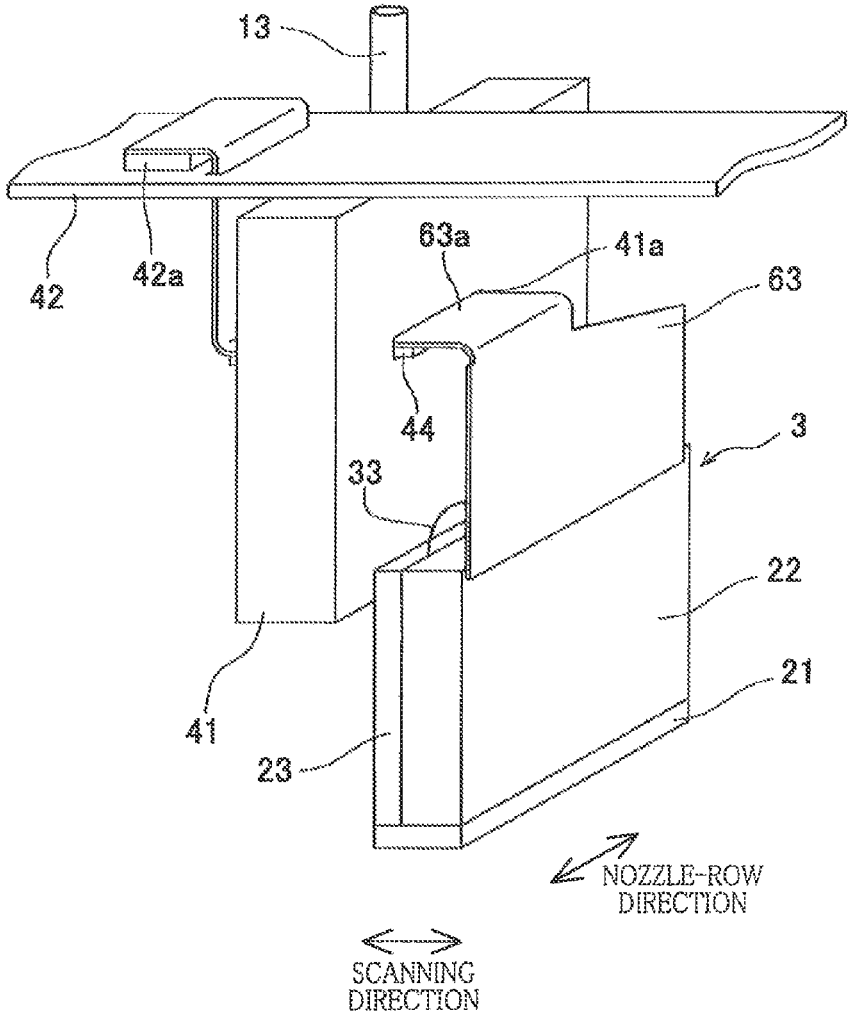
FIG. 6 is a view for explaining a first modification which corresponds to FIG. 3.

In a first modification shown in FIG. 6, a length of a COF 63 at a bent portion 63*a* and at a portion of the COF 63 that is nearer to the control circuit board 42 than the bent portion 63*a* is shorter in the nozzle-row direction than a length of the COF 63 at a portion thereof that is nearer to the piezoelectric plate 22 than the bent portion 63*a*. This is for the following reason. In order to provide a relatively large area A for routing the drive wirings 51, a length of the COF 63 in the nozzle-row direction has to be made relatively long between a portion of the COF 63 which is bonded to the piezoelectric plate 22 and a portion of the COF 63 on which the drive IC 44 is mounted the drive IC 44. However, at the bent portion 63*a* and at the portion of the COF 63 that is nearer to the control circuit board 42 than the bent portion 63*a*, the number of the control wirings 52 is less than that of the drive wirings 51 formed respectively for the electrodes 32. Thus, the length of the COF 63 in the nozzle-row direction can be made shorter.

As a result, a space in which there is no COF 63 is formed on a left side of the fixation member 41 (i.e., on the one side of the fixation member 41 in the second direction), and the tube 13 extends through the space. That is, in the first modification, the portion of the COF 63 which is located on a left side of the fixation member 41 and the tube 13 disposed on a left side of the fixation member 41 are displaced from each other in the nozzle-row direction but located at the same position in the scanning direction.

In the above-described embodiment, the length of the COF 43 in the nozzle-row direction is constant, and there is no space as described above on a left side of the fixation member 41. Thus, the tube 13 is disposed on a left side of the portion of the COF 43 which is located on a left side of the fixation member 41. However, in this first modification, the tube 13 and the COF 63 can be disposed at the same position in the scanning direction. Thus, a length of a space required for placing the ink jet head 3, the fixation member 41, the COF 63, the tube 13, and so on can be shortened in the scanning direction. As a result, a length of the carriage 2 in the scanning direction can be shortened, making it possible to reduce the size of the printer 1.

It is noted that, in the first modification, the length of the COF 63 in the nozzle-row direction is relatively short at the bent portion 63*a* and the portion of the COF 63 that is nearer to the control circuit board 42 than the bent portion 63*a*. However, in order to provide a space for placing the tube 13, a length of the COF 63 in the nozzle-row direction only needs to be short at least at the portion of the COF 63 that is nearer to the control circuit board 42 than the bent portion 63*a* and that is located on a left side of the fixation member 41 (i.e., on the one side of the fixation member 41 in the second direction).

Figure 7:
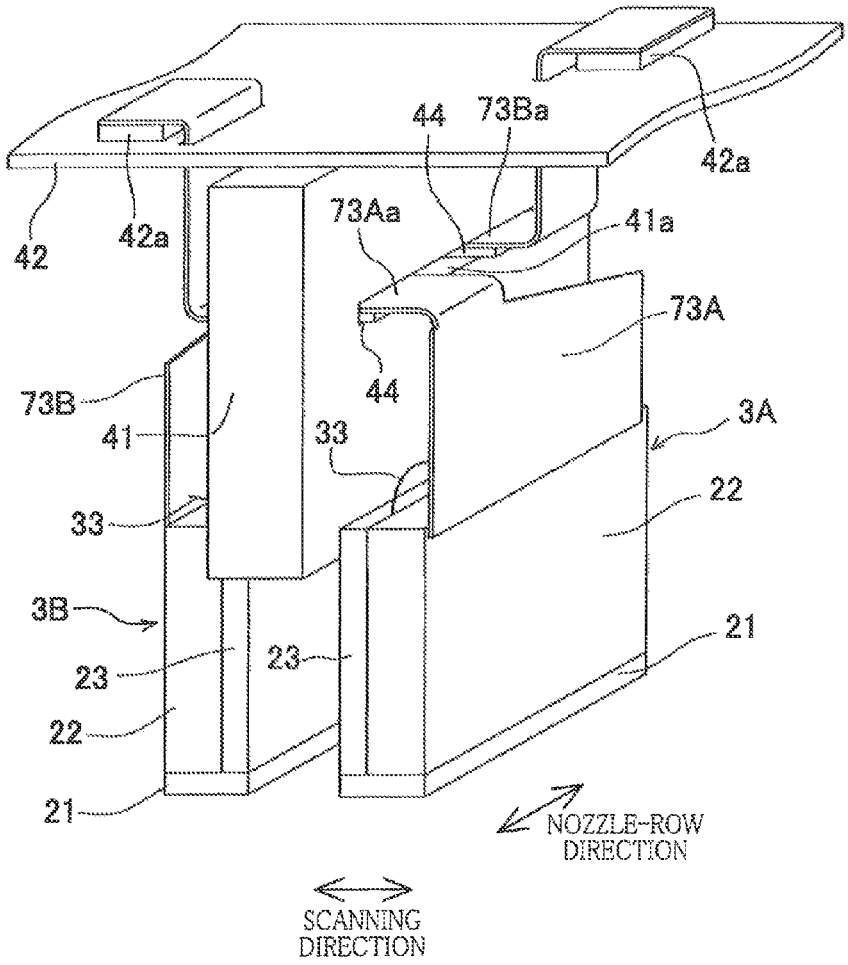
FIG. 7 is a view for explaining a second modification which corresponds to FIG. 3.

In a second modification shown in FIG. 7, the cover plates 23 of two ink-jet heads 3A, 3B are respectively bonded to opposite end faces of one fixation member 41 in the scanning direction. Further, two COFs 73A, 73B are provided so as to be connected to the respective two ink-jet heads 3A, 3B, and the COFs 73A, 73B respectively have bent portions 73Aa, 73Ba. As in the case of the COF 63 in the first modification (see FIG. 6), a length of each of the COFs 73A, 73B in the nozzle-row direction is made short at the corresponding bent portion and at a portion of the COF which is nearer to the control circuit board 42 than the corresponding bent portion when compared with a portion of the COF which is nearer to the piezoelectric plate 22 than the corresponding bent portion. The bent portions 73Aa, 73Ba of these two COFs 73A, 73B are inserted in or extend through the slit 41*a* so as to be displaced from each other in the nozzle-row direction.

It is noted that, in the second modification, the above-described ejection-energy applying portions of the ink-jet head 3A correspond to a plurality of first ejection-energy applying portions fixed on a right side of the fixation member 41 in FIG. 7 (i.e., on one side in the second direction). Further, the above-described ejection-energy applying portions of the ink-jet head 3B corresponds to a plurality of second ejection-energy applying portions fixed on a left side of the fixation member 41 in FIG. 7 (i.e., the other side of the fixation member 41 from the first ejection-energy applying portions in the second direction).

Further, the COF 73A connected to the wires 33 at a position located on a right side of the ink-jet head 3A is one example of a one-side wiring member. The COF 73B connected to the wires 33 at a position located on a left side of the ink-jet head 3B is one example of an other-side wiring member.

Though the tubes 13 for respectively supplying the inks to the two ink-jet heads 3 are not shown in FIG. 7, the ink supply openings 35 (see FIG. 2) are formed in faces of the two ink-jet heads 3A, 3B which face each other in this second modification. Thus, the tubes 13 are connected to the respective ink supply opening 35 by passing through the fixation member 41 so as not to interfere with the COFs 73A, 73B or by passing through a position between the two ink-jet head 3 respectively from opposite sides thereof in the nozzle-row direction, for example.

The cover plates 23 of the two ink-jet heads 3A, 3B are fixed to the opposite end faces of the one fixation member 41 in the scanning direction. Where the two COFs 73A, 73B respectively connected to these ink-jet heads 3A, 3B are supported by the fixation member 41, the COF 73A and the COF 73B need to be arranged so as not to interfere with each other. However, in this second modification, the COFs 73A, 73B are short in the nozzle-row direction at the bent portions 73Aa, 73Ba. Thus, the bent portion 73Aa and the bent portion 73Ba are inserted in the slit 41*a* so as to be displaced from each other in the nozzle-row direction, whereby the COF 73A and the COF 73B can be easily arranged so as not to interfere with each other. As a result, the length of the carriage 2 in the scanning direction can be shortened, making it possible to reduce the size of the printer 1.

It is noted that, in the second modification, the length of each of the COFs 73A, 73B in the nozzle-row direction is short at the corresponding bent portion (73Aa, 73Ba) and at the portion thereof nearer to the control circuit board 42 than the corresponding bent portion (73Aa, 73Ba). However, in order to prevent the COF 73A and the COF 73B from interfering with each other, the COFs 73A, 73B only needs to have a relatively short length in the nozzle-row direction at least at the bent portions 73Aa, 73Ba extending through the slit 41*a*.

Figure 8:
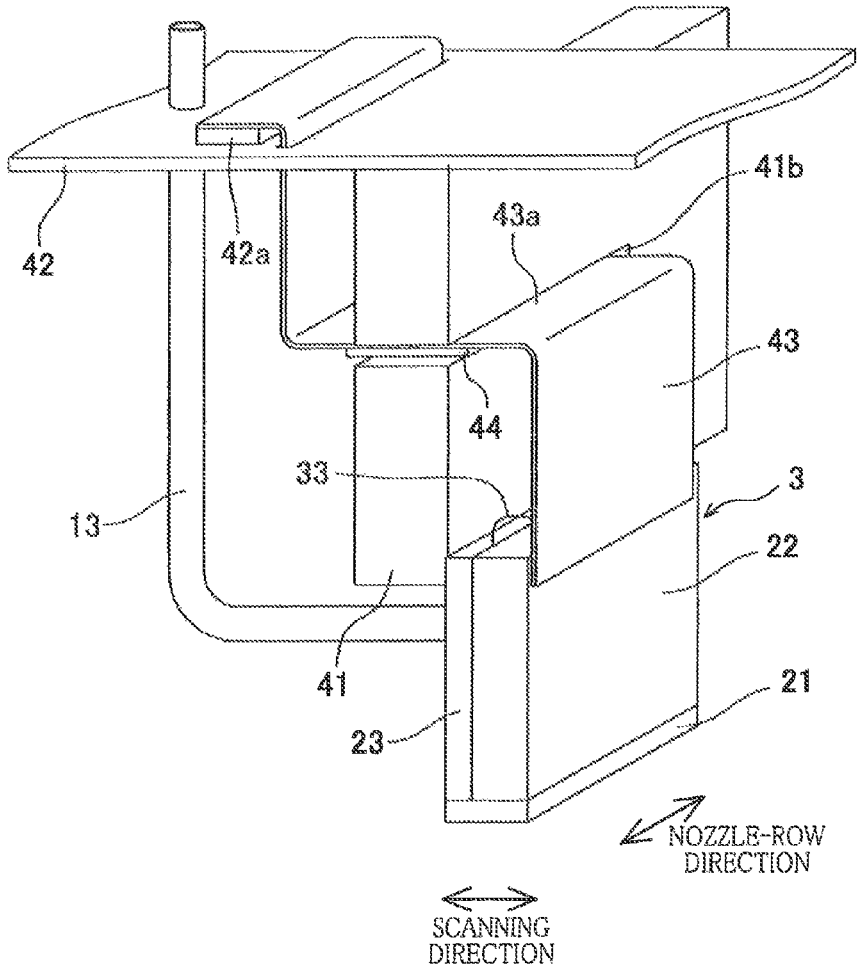
FIG. 8 is a view for explaining a third modification which corresponds to FIG. 3.

Further, in the above-described embodiment, the slit 41*a* formed in the fixation member 41 opens only in the opposite end portions of the fixation member 41 in the scanning direction, but the present invention is not limited to this construction. In a third modification shown in FIG. 8, a slit 41*b* formed in the fixation member 41 opens also in one end portion of the fixation member 41 in the nozzle-row direction. In this case, the bent portion 43*a* can be inserted through the opening in the one end portion of the fixation member 41 in the nozzle-row direction, making it easy to insert the bent portion 43*a* into the slit 41*a*.

Further, in the above-described embodiment, the drive IC 44 is mounted on the bent portion 43*a*, and the bent portion 43*a* is inserted in the slit 41*a* such that the drive IC 44 is located in the slit 41*a*, but the present invention is not limited to this construction.

Figure 9B:
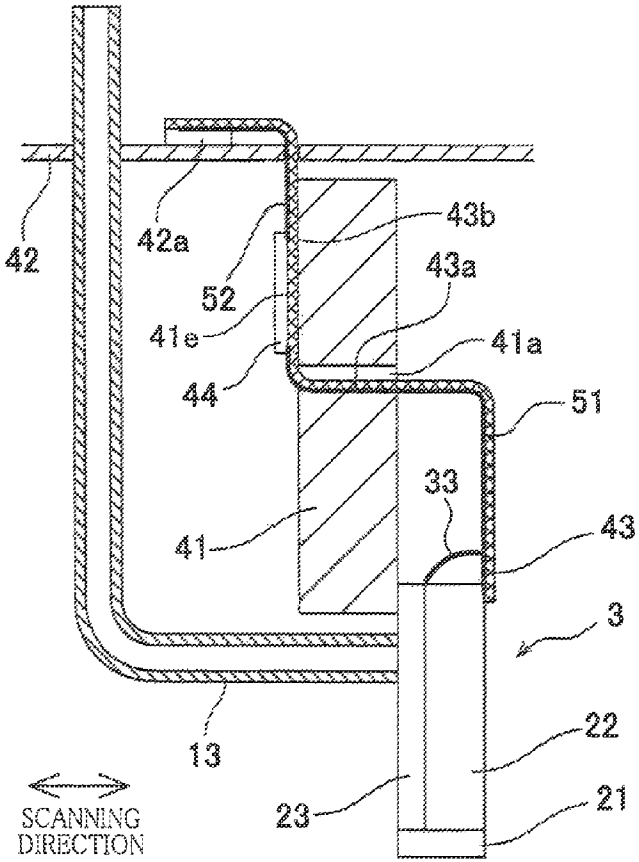
FIG. 9B is a view for explaining a fifth modification which corresponds to FIG. 4.
Figure 9A:
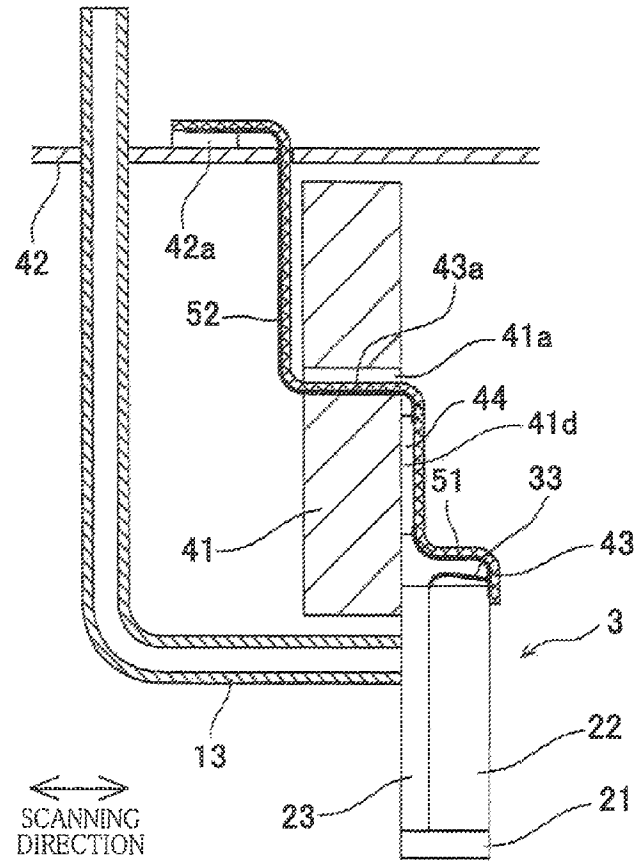
FIG. 9A is a view for explaining a fourth modification which corresponds to FIG. 4.

For example, as shown in FIG. 9A, as a fourth modification, this printer 1 may be configured such that the drive IC 44 is mounted at a position nearer to the piezoelectric plate 22 than the bent portion 43*a* located in the slit 41*a* and bonded to a right side face 41*d* (as one example of a first face) of the fixation member 41. That is, the COF 43 is supported by the fixation member 41 via the drive IC 44, and the fixation member 41 is held in direct contact with the drive IC 44, and the side face 41*d* of the fixation member 41 is held in direct contact with the face 44*a* of the drive IC 44.

Alternatively, as shown in FIG. 9B, as a fifth modification, the printer 1 may be configured such that the drive IC 44 is mounted at a position nearer to the control circuit board 42 than the bent portion 43*a* located in the slit 41*a*, and the portion of the COF 43 on which the drive IC 44 is mounted is bonded to a left side face 41*e* (as one example of the first face) of the fixation member 41. That is, the COF 43 is directly supported by the fixation member 41, and the fixation member 41 is held in direct contact with the COF 43, and the side face 41*e* of the fixation member 41 is held in direct contact with a face 43*b* of the COF 43 (i.e., a face of the portion of the COF 43 on which the drive IC 44 is mounted). It is noted that, in the modifications shown in FIGS. 9A and 9B, a lower face of the COF 43 is directly supported by the fixation member 41 in the slit 41*a*, but the lower face of the COF 43 may not be directly supported by the fixation member 41 in the slit 41*a*.

Further, in the above-described embodiment, the slit 41*a* is formed through the fixation member 41 in the scanning direction (i.e., in the direction perpendicular to the face of the fixation member 41), and the bent portion 43*a* extends in the scanning direction, but the printer 1 may be configured such that the slit 41*a* is formed through the fixation member 41 in a direction intersecting both of the upward and downward direction and the nozzle-row direction and inclined with respect to the scanning direction, and the bent portion 43*a* is bent so as to be parallel to the direction in which the slit 41 a is formed through the fixation member 41.

Further, in the above-described embodiment, the bent portion 43*a* is supported by the fixation member 41 in the slit 41*a* by being inserted in the slit 41*a*, but the present invention is not limited to this construction.

Figure 10:
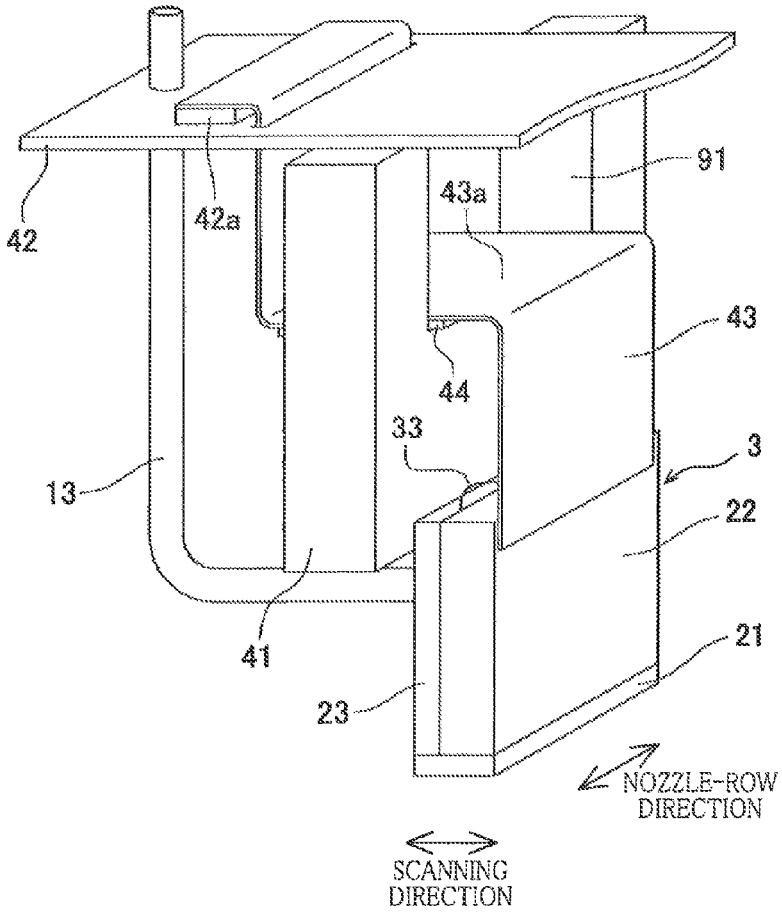
FIG. 10 is a view for explaining a sixth modification which corresponds to FIG. 3.
Figure 11:
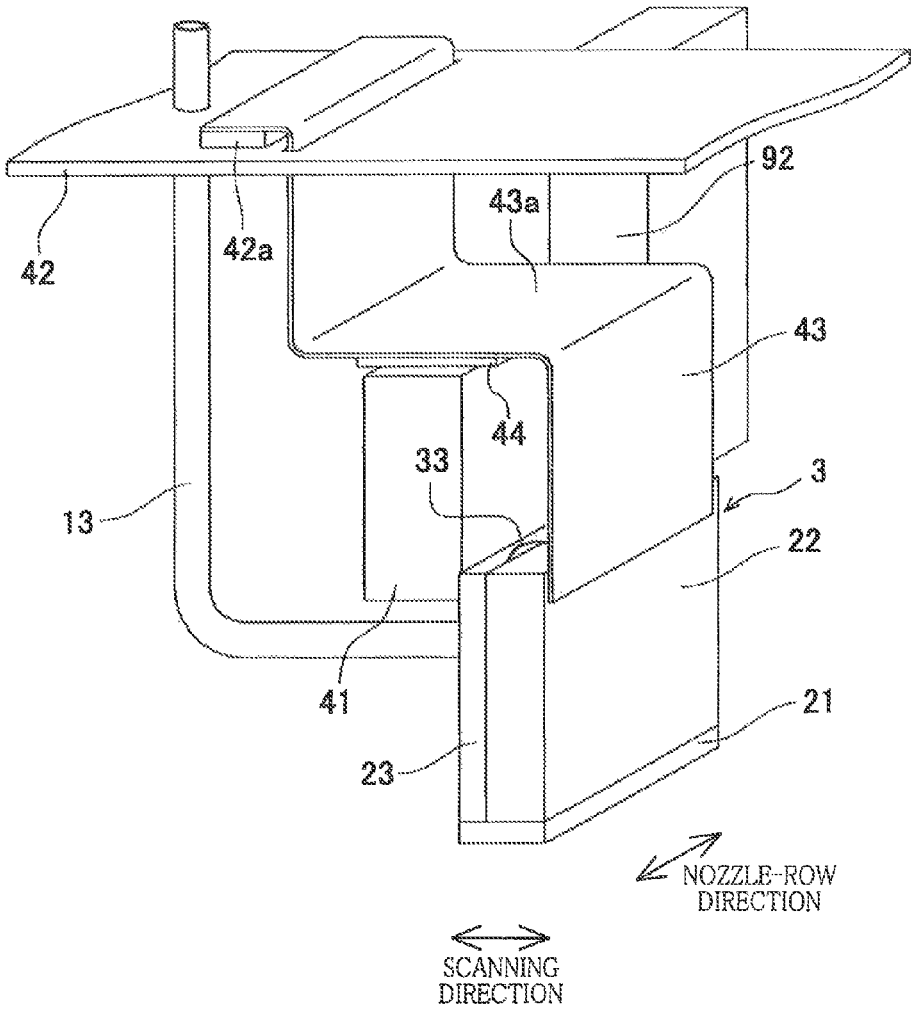
FIG. 11 is a view for explaining a seventh modification which corresponds to FIG. 3.

In a sixth modification shown in FIG. 10, the fixation member 41 has a cutout 91 formed in a generally central portion of the fixation member 41 in the nozzle-row direction. The cutout 91 extends upward from a generally central portion of the fixation member 41 in the vertical direction. In a seventh modification shown in FIG. 11, the fixation member 41 has a cutout 92 formed in a front portion of the fixation member 41 in the nozzle-row direction in FIG. 11. The cutout 92 extends upward from a generally central portion of the fixation member 41 in the vertical direction. That is, the fixation member 41 has a generally L-shape. In the sixth and seventh modifications, the bent portion 43*a* is supported by the fixation member 41 in the cutout 91, 92.

In the examples described above, the fixation member 41 extends to the position above the bent portion 43*a*, and the bent portion 43*a* is supported by the fixation member 41 in the slit 41*a* or the cutout 91 or 92 formed in the fixation member 41, but the present invention is not limited to this construction. For example, the printer 1 may be configured such that the upper end of the fixation member 41 is located at a height level generally the same as that of the bent portion 43*a*, and the bent portion 43*a* is supported by the upper end of the fixation member 41.

As in the fifth and sixth modifications, in the cases such as a case where the cutout 91 or 92 is formed in the fixation member 41 and a case where the above-described upper end of the fixation member 41 is located at the height level generally the same as that of the bent portion 43*a*, the COF 43 does not need to extend to a position located on a left side of the fixation member 41 and may be bent upward in the cutout 91 or 92 or at the upper face of the fixation member 41.

Figure 12:
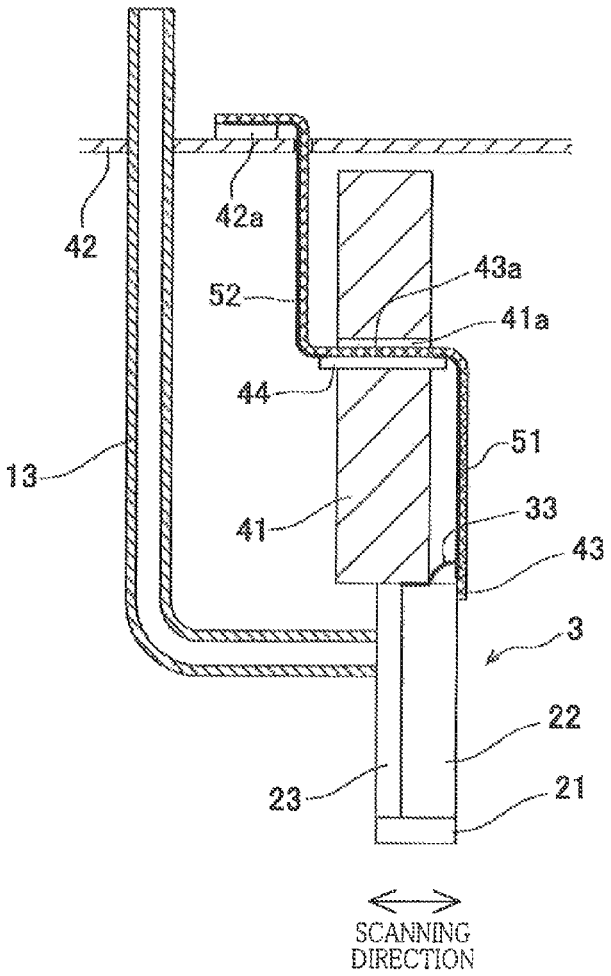
FIG. 12 is a view for explaining an eighth modification which corresponds to FIG. 4.

Further, in the above-described embodiment, the side face of the cover plate 23 is bonded to the side face of the fixation member 41, whereby the piezoelectric plate 22 is fixed to the fixation member 41, but the present invention is not limited to this construction. For example, in an eighth modification shown in FIG. 12, upper faces of the piezoelectric plate 22 and the cover plate 23 is bonded to a lower face of the fixation member 41, whereby the piezoelectric plate 22 is fixed to the fixation member 41. That is, the piezoelectric plate 22 may be fixed to the fixation member 41 in a manner different from that of the above-described embodiment.

Further, in the above-described examples, the wall portions 22*b* of the piezoelectric plate 22 which partly constitute the ejection-energy applying portions define the liquid channels of the ink-jet head 3, but the present invention is not limited to this construction, and the liquid channels may be provided independently of the ejection-energy applying portions. For example, the printer 1 may be configured such that each liquid channel is formed by a groove or a hole formed in a metal or a silicon circuit board, and the liquid channel are bonded to the ejection-energy applying portion formed by an actuator such as a PZT to provide the ink-jet head.

Further, in the above-described examples, the bent portion of the COF is supported by the fixation member 41, but a component supported by the fixation member 41 is not limited to the bent portion. That is, a portion of the COF between the piezoelectric plate and the control circuit board other than the bent portion may be supported by the fixation member 41. For example, the portion of the COF which is nearer to the piezoelectric plate than the bent portion or the portion of the COF which is nearer to the control circuit board 42 than the bent portion may be bonded to the fixation member. Also in such a case, it is possible to prevent the COF 43 having the bent portion 43*a* from hanging down.

Further, in the above-described examples, the fixation member 41 extends to the position above the ink-jet head 3 and supports the COF, that is, the fixation member 41 also functions as the support member for supporting the COF, but a component for supporting the COF may be provided on the carriage 2 independently of the fixation member 41.

Further, in the above-described examples, the present invention is applied to the printer including the ink-jet head 3 configured to eject the ink from the nozzles 20 to perform the recording on the recording sheet P, but the present invention is not limited to this. For example, the present invention is applicable to a liquid ejection apparatus including a liquid ejection head configured to eject liquid other than the ink from its nozzles.

What is claimed is:

1. A liquid ejection apparatus comprising:

at least one liquid ejection head each having:

a plurality of nozzles arranged in a nozzle-row direction;

a plurality of liquid channels respectively communicating with the plurality of nozzles; and a plurality of ejection-energy applying portions respectively corresponding to the plurality of liquid channels and arranged in the nozzle-row direction;

a drive IC configured to drive the plurality of ejection-energy applying portions;

a control circuit board configured to control the drive IC;

a flexible wiring member on which the drive IC is mounted, the wiring member including: a plurality of drive wirings for respectively connecting the plurality of ejection-energy applying portions and the drive IC to each other; and a control wiring for connecting the drive IC and the control circuit board to each other, the wiring member having a length longer than that of the drive IC in the nozzle-row direction, the wiring member being provided at least between the plurality of ejection-energy applying portions and the control circuit board; and a support member configured to support the wiring member, wherein the plurality of ejection-energy applying portions and the control circuit board are disposed so as to be distant from each other in a first direction that intersects the nozzle-row direction, wherein the wiring member extends toward the control circuit board from a connection portion thereof connected to the plurality of ejection-energy applying portions, the wiring member having a first wiring portion extending in the first direction and a second wiring portion extending in a second direction that intersects the first direction, wherein the support member is configured to support at least one of the first wiring portion and the second wiring portion of the wiring member, the at least one being located between the plurality of ejection-energy applying portions and the control circuit board, wherein the support member is configured to fix and support the plurality of ejection-energy applying portions, wherein the support member extends to a position that is nearer to the control circuit board than the plurality of ejection-energy applying portions in the first direction, and wherein the support member is configured to support the wiring member at a position that is nearer to the control circuit board than the plurality of ejection-energy applying portions.

2. The liquid ejection apparatus according to claim 1, wherein the support member is configured to support the second wiring portion of the wiring member.

3. The liquid ejection apparatus according to claim 1, wherein the second wiring portion extends in the first direction from the connection portion of the wiring member which is connected to the plurality of ejection-energy applying portions, and then the second wiring portion is bent in the second direction that further intersects the nozzle-row direction.

4. A liquid ejection apparatus comprising: at least one liquid ejection head each having a plurality of nozzles arranged in a nozzle-row direction; a plurality of liquid channels respectively communicating with the plurality of nozzles; and a plurality of ejection-energy applying portions respectively corresponding to the plurality of liquid channels and arranged in the nozzle-row direction; a drive IC configured to drive the plurality of ejection-energy applying portions; a control circuit board configured to control the drive IC; a flexible wiring member on which the drive IC is mounted, the wiring member including a plurality of drive wirings for respectively connecting the plurality of ejection-energy applying portions and the drive IC to each other; and a control wiring for connecting the drive IC and the control circuit board to each other, the wiring member having a length longer than that of the drive IC in the nozzle-row direction, the wiring member being provided at least between the plurality of ejection-energy applying portions and the control circuit board; and a support member configured to support the wiring member, wherein the plurality of ejection-energy applying portions and the control circuit board are disposed so as to be a distance from each other in a first direction that intersects the nozzle-row direction, wherein the wiring member extends toward the control circuit board from a connection portion thereof connected to the plurality of ejection-energy applying portions, the wiring member having a first wiring portion extending in the first direction and a second wiring portion extending in a second direction that intersects the first direction, wherein the support member is configured to support at least one of the first wiring portion and the second wiring portion of the wiring member, the at least one being located between the plurality of ejection-energy applying portions and the control circuit board, and wherein the second wiring portion extends in the first direction from the connection portion of the wiring member which is connected to the plurality of ejection-energy portion, and then the second wiring portion is bent in the second direction that further intersects the nozzle-row direction, wherein the support member is configured to contact at least one liquid ejection head wherein the support member extends in the first direction to a position that is nearer to the control circuit board than the second wiring portion, the support member having a slit formed therethrough in the second direction, and wherein the wiring member is configured such that the second wiring portion extends through the slit and is supported by the support member in the slit.

5. The liquid ejection apparatus according to claim 4, wherein the drive IC is mounted on the second wiring portion of the wiring member in the slit.

6. The liquid ejection apparatus according to claim 1, wherein the support member is configured to support the wiring member via the drive IC mounted on the wiring member.

7. The liquid ejection apparatus according to claim 6, wherein the support member is held in direct contact with the drive IC.

8. The liquid ejection apparatus according to claim 7, wherein the support member is held in surface contact with the drive IC.

9. The liquid ejection apparatus according to claim 8, wherein the support member has an upper face that is held in surface contact with a face of the drive IC.

10. The liquid ejection apparatus according to claim 8, wherein the support member has a first face expanding in the first direction, the first face being held in surface contact with a face of the drive IC.

11. The liquid ejection apparatus according to claim 1, wherein the support member is held in direct contact with the wiring member.

12. The liquid ejection apparatus according to claim 11, wherein the support member is held in contact with a face of the wiring member.

13. The liquid ejection apparatus according to claim 11, wherein the support member has a first face expanding in the first direction, the first face being held in direct contact with the wiring member.

14. The liquid ejection apparatus according to claim 4, wherein a supply-channel forming member defining a liquid supply channel that is connected to the liquid channel is disposed on one side of the support member in the second direction, wherein the wiring member has a portion extending from the connection portion thereof connected to the plurality of ejection-energy applying portions, to the second wiring portion, the portion being disposed on the other side of the support member in the second direction, wherein the wiring member has a portion located nearer to the control circuit board than the second wiring portion, the portion being disposed on the one side of the support member in the second direction, and wherein the supply-channel forming member and the portion of the wiring member which is located nearer to the control circuit board than the second wiring portion are disposed so as to be located at positions different from each other in the nozzle-row direction.

15. The liquid ejection apparatus according to claim 4, wherein the at least one liquid ejection head is a plurality of liquid ejection heads, wherein the plurality of liquid ejection heads include, each as one of the plurality of ejection-energy applying portions:

a plurality of first ejection-energy applying portions fixed on one side of the support member in the second direction; and a plurality of second ejection-energy applying portions fixed on the other side of the support member in the second direction, wherein the liquid ejection apparatus further comprises, each as the wiring member:

a one-side wiring member connected to the plurality of first ejection-energy applying portions on the one side of the support member in the second direction; and an other-side wiring member connected to the plurality of second ejection-energy applying portions on the other side of the support member in the second direction, and wherein the second wiring portion of the one-side wiring member and the second wiring portion of the other-side wiring member are disposed so as to be located at positions different from each other in the nozzle-row direction.

* * * * *